US007215906B2

(12) United States Patent
Kawai

(10) Patent No.: US 7,215,906 B2
(45) Date of Patent: May 8, 2007

(54) DEVELOPING UNIT WITH GRIPPER THAT COVERS DEVELOPER FILLING OPENING

(75) Inventor: Hideaki Kawai, Mukoh (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 233 days.

(21) Appl. No.: 11/036,555

(22) Filed: Jan. 14, 2005

(65) Prior Publication Data

US 2005/0158072 A1 Jul. 21, 2005

(30) Foreign Application Priority Data

Jan. 19, 2004 (JP) ..... 2004-011197

(51) Int. Cl.
*G03G 15/08* (2006.01)

(52) U.S. Cl. ..... 399/119

(58) Field of Classification Search ..... 399/107, 399/111, 113, 119, 262; 222/465.1, 467, 222/DIG. 1
See application file for complete search history.

(56) References Cited

U.S. PATENT DOCUMENTS 4,017,005 A * 4/1977 Forbes, Jr. ..... 222/47
4,839,691 A * 6/1989 Tagawa et al. ..... 399/12
5,802,433 A * 9/1998 Sato et al. ..... 399/111
5,812,915 A * 9/1998 Farkash ..... 399/262
5,899,602 A * 5/1999 Noda et al. ..... 399/111
D445,822 S * 7/2001 Tosa et al. ..... D18/40
6,560,431 B2 * 5/2003 Hosokawa ..... 399/258
6,640,066 B2 * 10/2003 Sato ..... 399/106
6,978,107 B2 * 12/2005 Nagashima et al. ..... 399/262

FOREIGN PATENT DOCUMENTS

JP 59206849 A * 11/1984
JP 05-113721 5/1993
JP 05-232811 9/1993
JP 2000-132064 5/2000

* cited by examiner

*Primary Examiner*—Robert Beatty
(74) *Attorney, Agent, or Firm*—Hogan & Hartson LLP

(57) ABSTRACT

A developing unit includes a container in which a developer is accumulated inside, a developer filling opening which is formed on the container and a gripper which is fixed on an outer surface of the container so as to cover the developer filling opening.

8 Claims, 6 Drawing Sheets

DEVELOPING UNIT WITH GRIPPER THAT COVERS DEVELOPER FILLING OPENING

BACKGROUND OF THE INVENTION

1. Field of the Invention

The present invention relates to a developing unit for developing an electrostatic latent image by adhering a developer on the electrostatic latent image, used in an image forming device such as a copying machine, a printer and a facsimile machine.

2. Description of Related Art

An image forming device carries out an image forming process by adhering a developer (toner) on an electrostatic latent image carrier on which an electrostatic latent image is formed. Accompanying the image forming process, the developer is consumed and a remaining amount of the developer decreases. Therefore, the developer is required to be replenished as needed. Accordingly, a developing unit is provided removably with respect to the image forming device so that when necessary, the developing unit can be removed from the image forming device to replenish the developer or to replace the developing unit.

In general, a gripper is provided on the developing unit so that the developing unit can be inserted and removed easily. Various conventional improvements on the gripper have been proposed. For example, according to one conventional improvement, an auxiliary tank of the toner also functions as the gripper. According to another conventional improvement, a concave part is formed on an upper part of an upper frame of a process cartridge in a longitudinal direction so that an operator's finger can be placed in.

When the developing unit is inserted removably in the image forming device as described above, the developer can be replenished in the developing unit and the developing unit can be reused. However, if developer that is noncompliant with the image forming device is replenished in the developing unit and the developing unit is reused, there are cases in which the developer causes a negative influence on the image forming device. Therefore, a countermeasure is required for preventing undesired developer from being replenished in the developing unit.

Accordingly, there is a demand for a developing unit which prevents the developer from being replenished easily in the developing unit by a simple structure using the gripper generally provided on the developing unit.

SUMMARY OF THE INVENTION

According to an aspect of the present invention, a developing unit includes a container, a developer replenish opening and a gripper. The container accumulates developer inside. The container includes a developer carrier which adheres the developer onto an electrostatic latent image carrier. The developer replenish opening is formed on the container. The gripper is fixed on an outer surface of the container so as to cover the developer replenish opening. It is preferable that a cover is provided on the container so as to seal the developer replenish opening, and the gripper is fixed by being provided so as to cross the cover. The gripper is preferable to be fixed on the container by screws at both sides of the cover. Furthermore, the gripper is preferable to be fixed on the container by welding at both sides of the cover.

According to the aspect of the present invention, the gripper is fixed on the container so as to cover the developer replenish opening from where the developer is replenished.

Therefore, unless removing the gripper from the container, the developer cannot be replenished from the developer replenish opening. If the gripper is removed from the container, the developing unit without the gripper becomes extremely troublesome to be inserted and removed. Therefore, a certain deterrent effect can be expected for the removable of the gripper. As a result, the developer may not be replenished easily in the developing unit. In addition, since the gripper which is provided conventionally is used, a new component is not necessary to be added.

Furthermore, the gripper is fixed by being provided so as to cross the cover sealing the toner replenish opening. Therefore, the cover can be prevented from being removed from the developer replenish opening by a simple structure. Moreover, the gripper is fixed on the container by the screws at both sides of the cover. As a result, the developing unit can be disassembled easily when recycling. The gripper is fixed on the container by welding at both sides of the cover. As a result, the gripper becomes extremely difficult to be removed and safety can be improved even more.

DETAILED DESCRIPTION OF THE INVENTION

Embodiments of the present invention will be described. Further, the embodiments to be described below are preferable specific examples for implementing the present invention. Therefore, there are various technical limitations in the description. However, unless explicitly stated in the following description to limit the present invention, the present invention shall not be limited to the embodiments.

Figure 1:
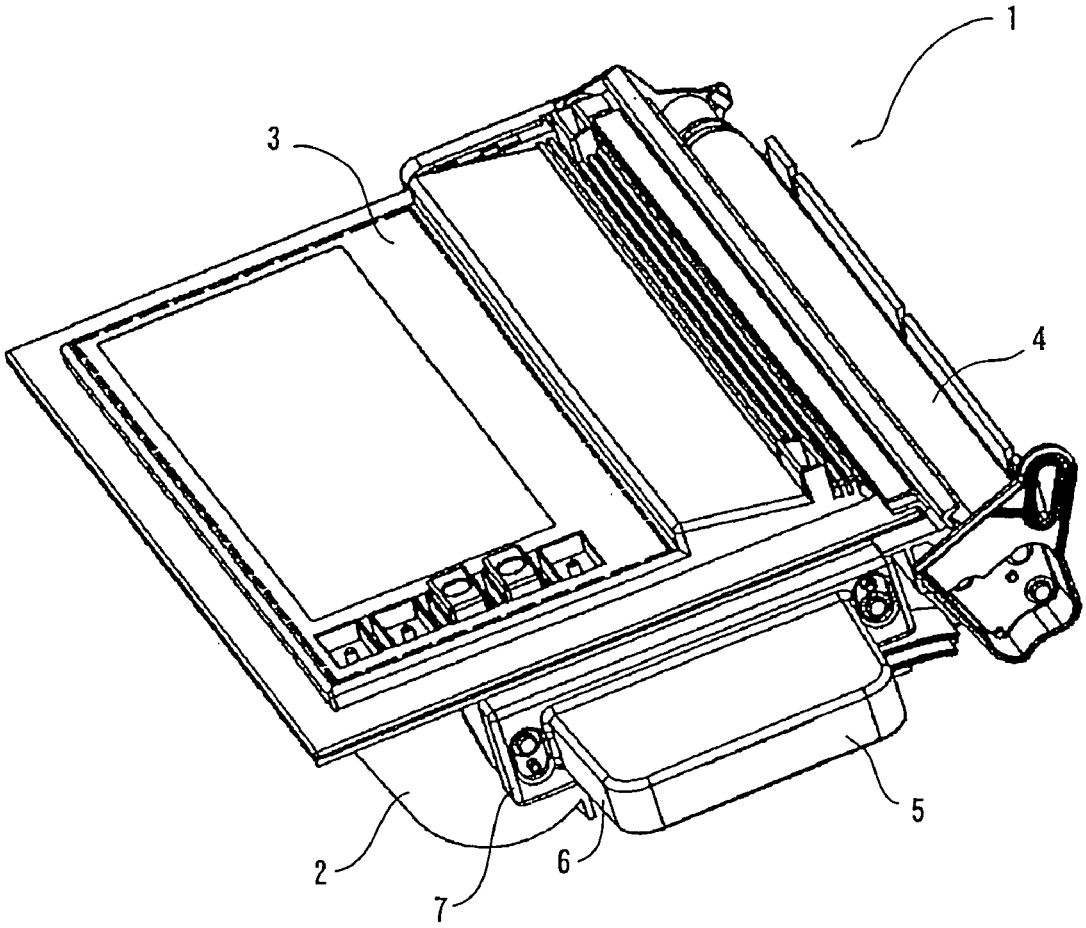
FIG. 1 is a perspective view showing a developing unit according to an embodiment of the present invention.

FIG. 1 is a perspective view of a developing unit 1 viewed from an upper side. The developing unit 1 includes a container 2 and an upper cover 3. Inside the container 2, a replenish chamber is formed for accumulating a toner which is a developer. A developing roller 4 is mounted rotatably on an end part of the developing unit 1 at a right side of the page of FIG. 1. An agitator is provided in the replenish chamber. By the agitator being rotated, the agitator agitates the toner and replenishes the toner on the developing roller 4. This structure is the same as the structure of a conventional developing unit. The upper cover 3 is fixed so as to seal an upper opening of the container 2. The upper cover 3 and the container 2 are sealed with an adhesive. Accordingly, the toner is prevented from leaking. In addition, it becomes extremely difficult to remove the upper cover 3 and to replenish the toner.

Figure 2:
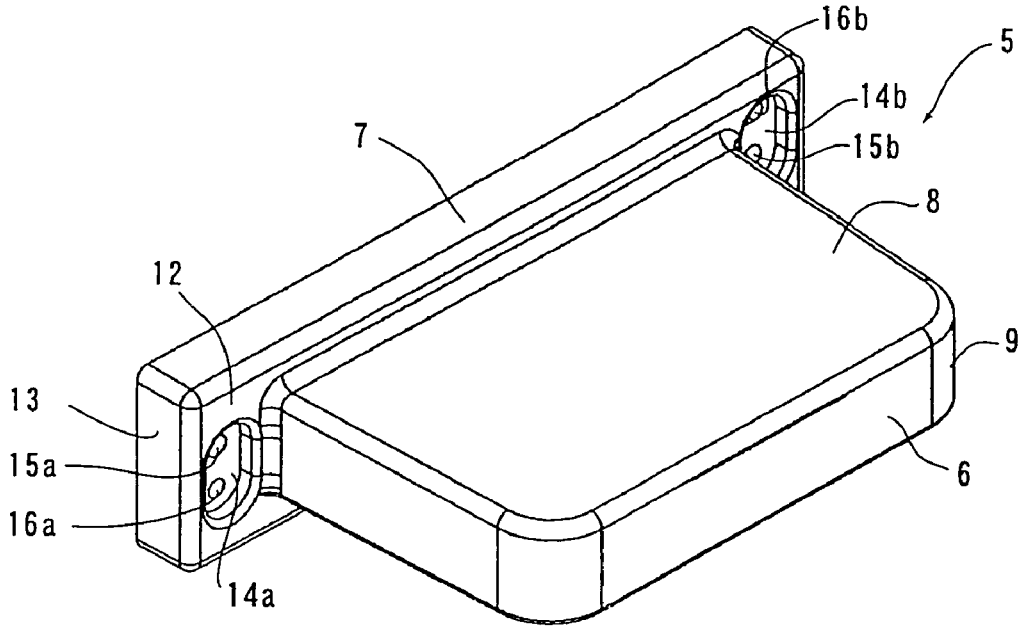
FIG. 2 is a perspective view of a gripper viewed from an upper side.
Figure 3:
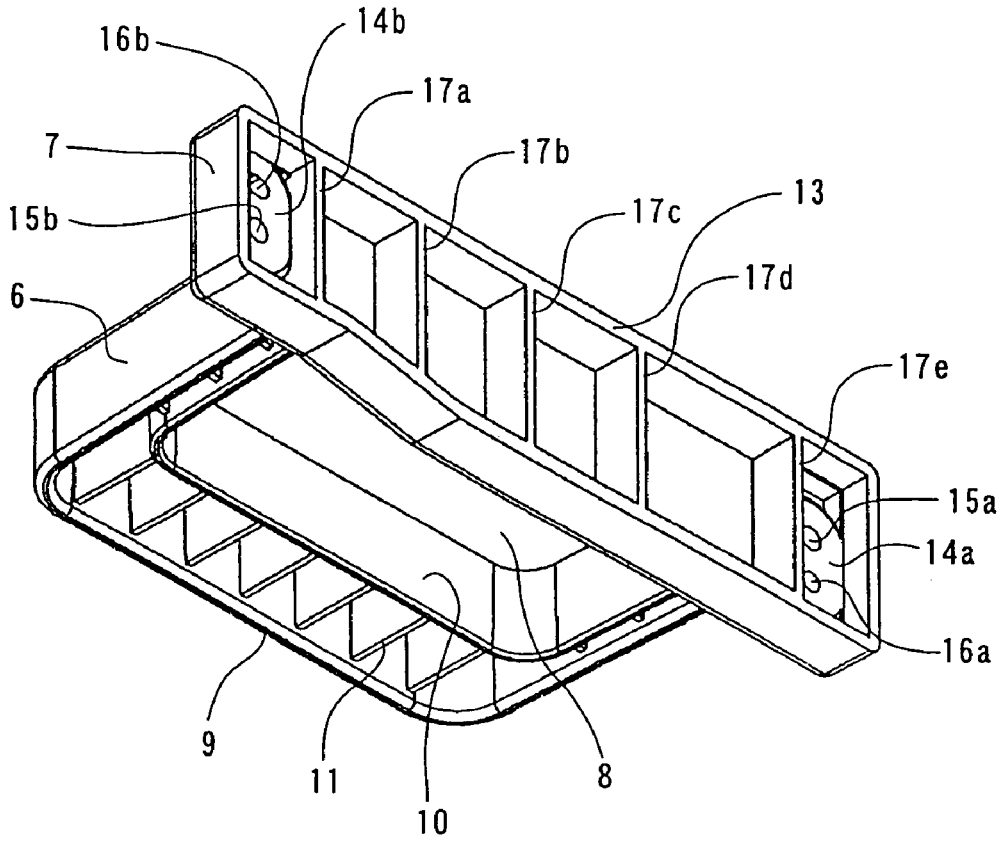
FIG. 3 is a perspective view of the gripper viewed from a lower side.

At a front side of the page of FIG. 1, a gripper 5 is fixed on the container 2 of the developing unit 1. The gripper 5 includes a handle 6 and a fixed part 7. The handle 6 is formed so as to protrude outward from the fixed part 7. FIG. 2 is a perspective view of the gripper 5 viewed from an upper side. FIG. 3 is a perspective view of the gripper 5 viewed from a lower side.

The handle 6 includes an upper surface member 8 and a side surface member 9. The upper surface member 8 is plate shaped and rectangular. One end part of the upper surface member 8 is formed integrally on the fixed part 7. The side surface member 9 is suspended from a periphery of the upper surface member 8. The side surface member 9 has a prescribed width and is formed in the shape of the letter U. A belt-shaped member 10 is provided between the side surface member 9 and the fixed part 7. The belt-shaped member 10 is suspended from a lower surface of the upper surface member 8. The belt-shaped member 10 is provided with a prescribed interval spaced from the side surface member 9. The belt-shaped member 10 is formed in the shape of the letter U. A plurality of rectangular ribs 11 are provided between the side surface member 9 and the belt-shaped member 10. Each of the ribs 11 is formed to be orthogonal to the upper surface member 8, the side surface member 9 and the belt-shaped member 10. The handle 6 can be gripped easily by inserting an operator's finger into the space between the belt-shaped member 10 and the fixed part 7. Since the plurality of ribs 11 are provided, the gripper 6 is strong enough for a gripping force.

The fixed part 7 includes a rectangular front surface member 12 and a peripheral surface member 13. The front surface member 12 is formed integrally with the handle 6. The peripheral surface member 13 having a prescribed width is provided to surround the front surface member 12. A pair of oval-shaped attaching concaves 14*a* and 14*b* are formed on both sides of the handle 6 on the front surface member 12. Each of the attaching concaves 14*a* and 14*b* is caved in toward the container 2. Screw mounting holes 15*a* and 15*b* and boss mounting holes 16*a* and 16*b* are formed through the attaching concaves 14*a* and 14*b*, respectively. As shown in FIG. 2, on the left-side attaching concave 14*a*, the boss mounting hole 16*a* is formed below the screw mounting hole 15*a*. On the right-side attaching concave 14*b*, the boss mounting hole 16*b* is formed below the screw mounting hole 15*b*. A plurality of ribs 17*a* through 17*e* are formed inside the peripheral surface member 13. Each of the ribs 17*a* through 17*e* is orthogonal to the longitudinal direction of the fixed part 7, respectively. The ribs 17*a* and 17*e* are formed in proximity of a side of the attaching concaves 14*a* and 14*b*, respectively. The ribs 17*a* and 17*e* improve the strength of the attaching concaves 14*a* and 14*b*. As to be described later, the ribs 17*a* and 17*e* are used for positioning when fitting attaching protrusions 20*a* and 20*b*. The ribs 17*b* through 17*d* are also formed with a prescribed interval between one another to strengthen the fixed part 7.

Figure 4:
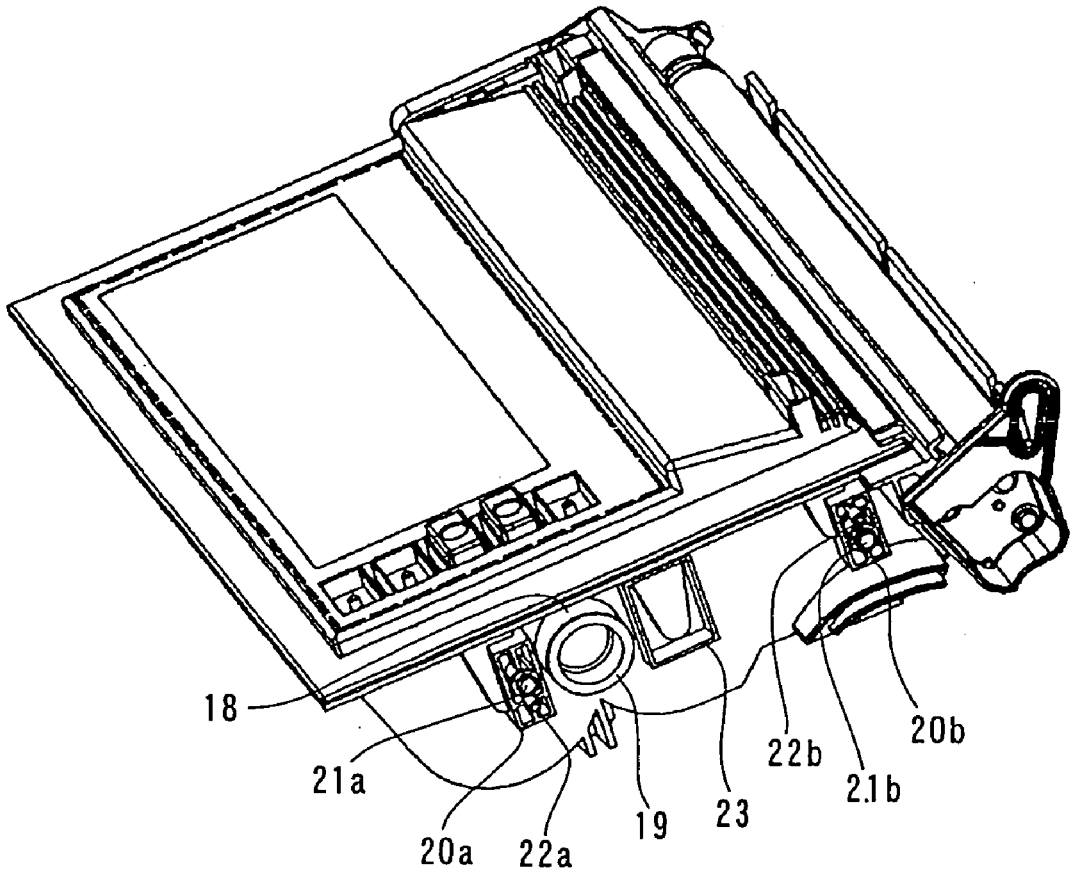
FIG. 4 is a perspective view showing a state in which the gripper is removed.

FIG. 4 is a perspective view of the developing unit 1 under a state in which the gripper 5 is removed. A circular toner filling opening 18 is formed on a side surface of the container 2. A cylindrical shaped part is formed at the toner filling opening 18, protruding a prescribed length from the side surface of the container 2. An opening of the toner filing opening 18 is sealed by a cap 19.

A pair of the attaching protrusions 20*a* and 20*b* are fixed on the container 2 at both the left and right of the toner filling opening 18. The left-side attaching protrusion 20*a* is provided in proximity to the toner filing opening 18. The right-side attaching protrusion 20*b* is provided at a position located away from the toner filling opening 18. The pair of the attaching concaves 14*a* and 14*b* formed on the fixed part 7 of the gripper 5 are fit onto the attaching protrusions 20*a* and 20*b*, respectively. The attaching protrusions 20*a* and 20*b* are formed in a rectangular shape. The shape of the attaching protrusions 20*a* and 20*b* is approximately the same as the peripheral surface member 13 of the fixed part 7 and the ribs 17*a* and 17*e* formed to surround the attaching concaves 14*a* and 14*b*. Therefore, by fitting the pair of the attaching concaves 14*a* and 14*b* onto the attaching protrusions 20*a* and 20*b*, the gripper 5 is positioned on the container 2.

Figure 5:
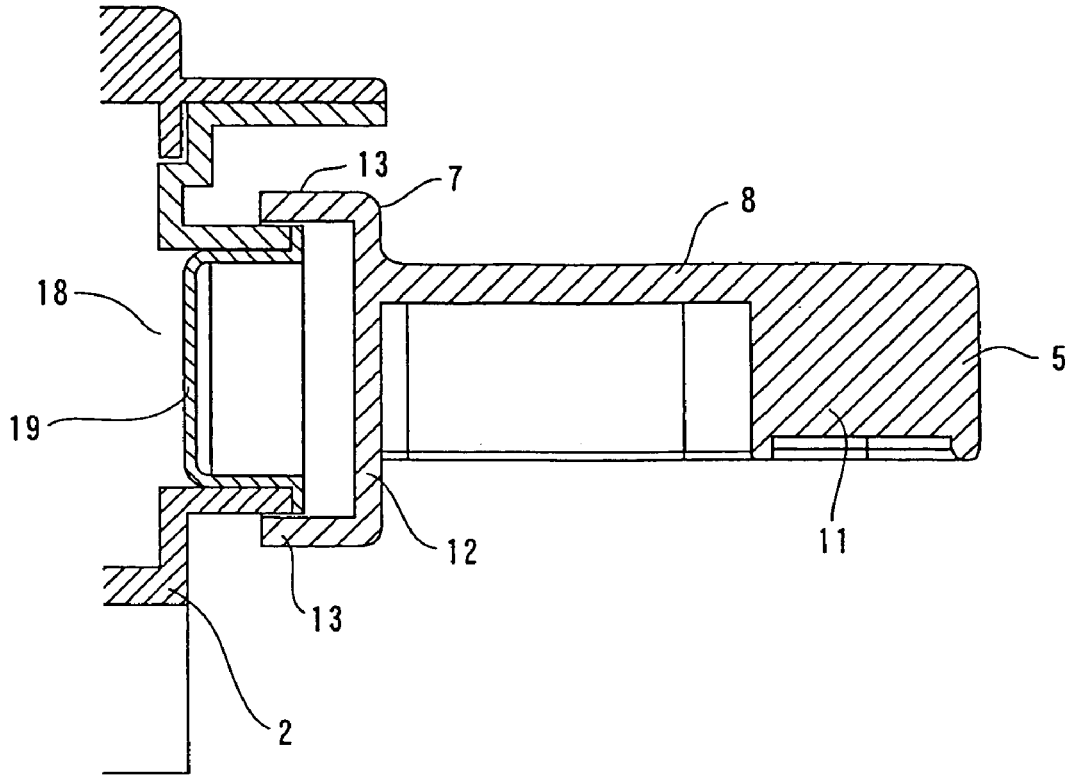
FIG. 5 is a cross-sectional view of a toner filling opening under a state in which the gripper is set.

When the gripper 5 is set on the container 2, the toner filling opening 18 is fit in the space between the ribs 17*d* and 17*e* of the fixed part 7. FIG. 5 is a vertical cross-sectional view of the toner filling opening 18 under a state in which the gripper 5 is set. By setting the gripper 5, the toner filling opening 18 is covered by the gripper 5. Accordingly, unless removing the gripper 5, the toner filling opening 18 cannot be opened from the outside. An attaching frame 23 is provided at the right side of the toner filing opening 18. When the gripper 5 is set, the attaching frame 23 is fit between the ribs 17*c* and 17*d* of the fixed part 7. As a result, an attached strength of the gripper 5 increases.

Figure 6:
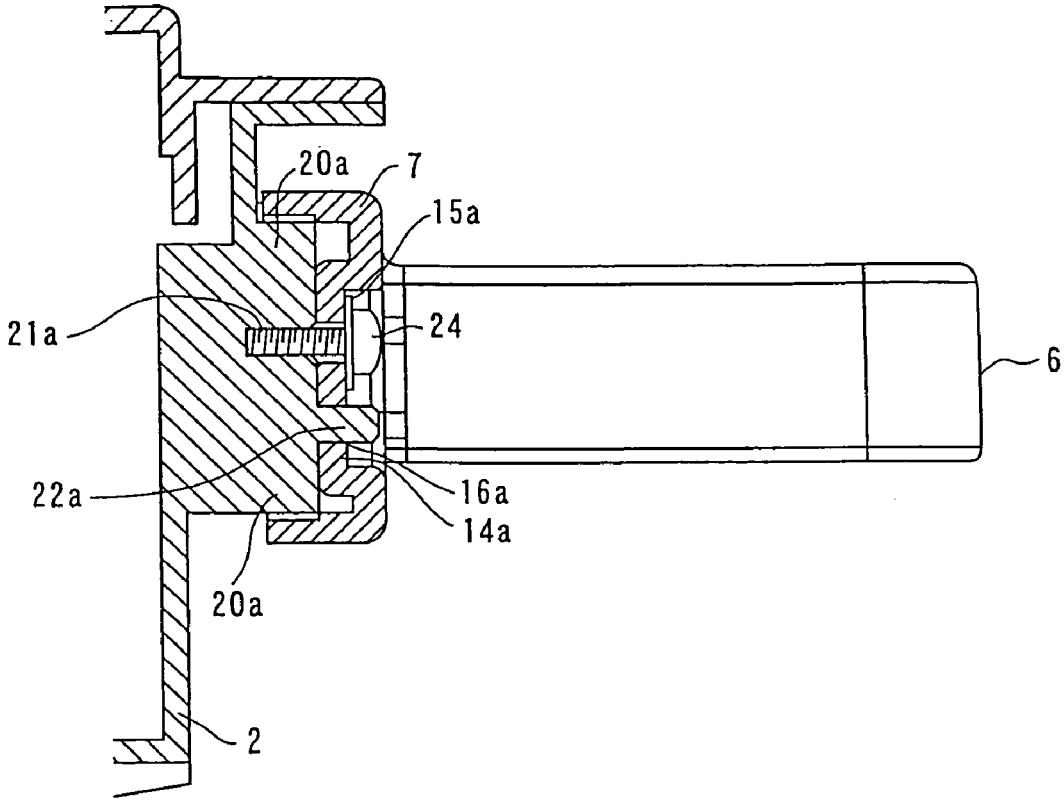
FIG. 6 is a cross-sectional view of an attaching protrusion under the state in which the gripper is set.

A screw hole 21*a* and a boss 22*a* are provided on the attaching protrusion 20*a*. A screw hole 21*b* and a boss 22*b* are provided on the attaching protrusion 20*b*. When the attaching concave 14*a* is fit onto the attaching protrusion 20*a*, the screw mounting hole 15*a* and the boss mounting hole 16*a* formed on the attaching concave 14*a* are disposed at a position approximately consistent with the screw hole 21*a* and the boss 22*a*, respectively. In the same manner, the screw mounting hole 15*b* and the boss mounting hole 16*b* formed on the attaching concave 14*b* are disposed at a position approximately consistent with the screw hole 21*b* and the boss 22*b*, respectively. FIG. 6 is a vertical cross-sectional view of the attaching protrusion 20*a* under a state in which the gripper 5 is set. A screw 24 is inserted through the screw mounting hole 15*a* and the screw hole 21*a* and fixed. The boss 22*a* is inserted though the boss mounting hole 16*a*. A positioning is carried out by inserting the boss 22*a* through the boss mounting hole 16*a*. The screw mounting hole 15*a* and the screw hole 21*a* are positioned accurately. The attaching concave 14*b* and the attaching protrusion 20*b* are positioned in the same manner. By heating a summit of the bosses 22*a* and 22*b*, the bosses 22*a* and 22*b* can be welded onto the attaching concaves 14*a* and 14*b*. Accordingly, the fixed part 7 is fixed onto the container 2 and the gripper 5 becomes difficult to be removed.

As described above, by fixing the gripper 5 onto the container 2, the toner filling opening 18 is covered by the gripper 5. By fixing with the screw 24 and by welding the bosses 22*a* and 22*b*, the gripper 5 becomes extremely difficult to be removed. To facilitate recycling, the bosses 22*a* and 22*b* may be not welded. Accordingly, by removing the screw 24, the gripper 5 can be separated from the container 2 without destroying the gripper 5.

The invention claimed is:

1. A developing unit, comprising:

a container in which a developer is accumulated inside;

a developer filling opening which is formed on the container; and a gripper which is fixed on an outer surface of the container so as to cover the developer filling opening, wherein the gripper includes a handle and a fixed part, and the handle is formed so as to protrude outward from the fixed part, the handle includes an upper surface member and a side surface member, the upper surface member is rectangular and plate shaped, and is formed integrally on the fixed part, and the side surface member is suspended from a periphery of the upper surface member and is formed in a shape of a letter U.

2. The developing unit according to claim 1, further comprising a cap which is mounted on the container and seals the developer filling opening, wherein the gripper is provided so as to cover the cap.

3. The developing unit according to claim 2, further comprising screw members which fix the gripper onto the container at both sides of the cap.

4. The developing unit according to claim 2, wherein the gripper is welded onto the container at both sides of the cap.

5. The developing unit according to claim 1, wherein the handle includes a belt-shaped member and a plurality of rectangular ribs, the belt-shaped member is suspended from a lower surface of the upper surface member, provided with a prescribed interval spaced from the side surface member and is formed in a shape of a letter U, and each of the ribs is provided between the side surface member and the belt-shaped member and is orthogonal to the upper surface member, the side surface member and the belt-shaped member.

6. A developing unit comprising:

a container in which a developer is accumulated inside;

a developer filling opening which is formed on the container; and a gripper which is fixed on an outer surface of the container so as to cover the developer filling opening, wherein the gripper includes a handle and a fixed part, and the handle is formed so as to protrude outward from the fixed part, and wherein the fixed part includes a rectangular front surface member and a peripheral surface member, and the handle is formed integrally on the rectangular front surface member and the peripheral surface member surrounds a periphery of the front surface member.

7. The developing unit according to claim 6, wherein a pair of attaching concaves are formed on the rectangular front surface member at both sides of the handle, a pair of attaching protrusions are provided on the container at both sides of the developer filling opening, and the attaching protrusions are fit in the attaching concaves.

8. The developing unit according to claim 7, wherein each of the attaching concaves is formed in an oval shape and caved in toward the container, and a screw mounting hole and a boss mounting hole are formed through each of the concaves, a screw hole and a boss are formed on each of the attaching protrusions, and when the attaching protrusions are fit in the attaching concaves, the screw mounting hole and the screw hole, and the boss mounting hole and the boss are disposed at a position corresponding with one another, respectively.

* * * * *